US010280381B2

(12) United States Patent
Patel et al.

(10) Patent No.: US 10,280,381 B2
(45) Date of Patent: May 7, 2019

(54) ADDITIVE FOR LUBRICANT COMPOSITIONS COMPRISING AN ORGANOMOLYBDENUM COMPOUND, AND A DERIVATIZED TRIAZOLE

(71) Applicant: VANDERBILT CHEMICALS, LLC, Norwalk, CT (US)

(72) Inventors: Mihir K. Patel, Norwalk, CT (US); Vincent J. Gatto, Bradenton, FL (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 0 days.

(21) Appl. No.: 15/226,313

(22) Filed: Aug. 2, 2016

(65) Prior Publication Data

US 2017/0044457 A1 Feb. 16, 2017

Related U.S. Application Data

(60) Provisional application No. 62/205,240, filed on Aug. 14, 2015, provisional application No. 62/205,250, filed on Aug. 14, 2015.

(51) Int. Cl.

| | |
|---|---|
| ***C10M 141/08*** | (2006.01) |
| ***C10M 141/06*** | (2006.01) |
| ***C10M 169/04*** | (2006.01) |
| ***C10M 141/12*** | (2006.01) |
| ***C10M 163/00*** | (2006.01) |

(52) U.S. Cl.

CPC ..... *C10M 141/12* (2013.01); *C10M 141/06* (2013.01); *C10M 163/00* (2013.01); *C10M 2215/064* (2013.01); *C10M 2215/223* (2013.01); *C10M 2215/30* (2013.01); *C10M 2219/068* (2013.01); *C10M 2227/066* (2013.01); *C10M 2227/09* (2013.01); *C10N 2210/06* (2013.01); *C10N 2230/06* (2013.01); *C10N 2230/12* (2013.01); *C10N 2230/36* (2013.01); *C10N 2240/102* (2013.01); *C10N 2270/02* (2013.01)

(58) Field of Classification Search

CPC combination set(s) only.
See application file for complete search history.

(56) References Cited

U.S. PATENT DOCUMENTS

| | | | |
|---|---|---|---|
| 4,734,209 | A | 3/1988 | Phillips et al. |
| 5,580,482 | A | 12/1996 | Chasan et al. |
| 5,840,672 | A | 11/1998 | Gatto et al. |
| 6,184,262 | B1 | 2/2001 | Suhoza et al. |
| 6,723,685 | B2 | 4/2004 | Hartley et al. |
| 6,743,759 | B2 | 6/2004 | Stunkel et al. |
| 2004/0038835 | A1 | 2/2004 | Chasan et al. |
| 2007/0170392 | A1 | 7/2007 | Foister et al. |
| 2008/0200357 | A1 | 8/2008 | Chasan et al. |
| 2010/0009875 | A1 | 1/2010 | Dong |
| 2010/0173808 | A1 | 7/2010 | Chasan et al. |
| 2010/0331224 | A1 | 12/2010 | Boffa et al. |
| 2011/0237474 | A1 | 9/2011 | Mazzamaro et al. |
| 2012/0258896 | A1 | 10/2012 | Aguilar et al. |
| 2015/0133352 | A1 | 5/2015 | Esche et al. |

FOREIGN PATENT DOCUMENTS

| | | | |
|---|---|---|---|
| JP | 2005509732 | A | 4/2005 |
| JP | 2009149890 | A | 7/2009 |
| JP | 2015518912 | A | 7/2015 |
| KR | 20050032104 | A | 4/2005 |
| WO | 2004/015043 | A1 | 2/2004 |

OTHER PUBLICATIONS

International Search Report dated Sep. 22, 2016, dated Oct. 17, 2016.

Japanese Office Action for corresponding application JP 2018-507508 with English translation, dated Nov. 15, 2018.

Response filed in Australia to AU Office action dated Jun. 5, 2018, in corresponding application AU 2016307780 dated Jan. 17, 2019.

European Search Report for corresponding application EP 16837483 dated Jan. 21, 2019.

KR Office Action for corresponding application KR 10-2018-7003718 with English translation, dated Feb. 7, 2018.

*Primary Examiner* — Ellen M McAvoy

*Assistant Examiner* — Chantel L Graham

(74) *Attorney, Agent, or Firm* — Norris McLaughlin PA

(57) ABSTRACT

A lubricating composition for use in heavy duty diesel engines which is formulated to allow the use of organo-molybdenum compounds but which overcomes the issue of Cu and/or Pb corrosion and also maintains elastomer seal compatibility. The lubricant is characterized by having a composition comprising (A) an organo-molybdenum compound, (B) an alkylated diphenylamine derivative of triazole, (C) base oil, and optionally (D) one or more additives selected from the group including antioxidants, dispersants, detergents, anti-wear additives, extreme pressure additives, friction modifiers, rust inhibitors, corrosion inhibitors, seal swell agents, anti-foaming agents, pour point depressants and viscosity index modifiers.

16 Claims, No Drawings

ADDITIVE FOR LUBRICANT COMPOSITIONS COMPRISING AN ORGANOMOLYBDENUM COMPOUND, AND A DERIVATIZED TRIAZOLE

DESCRIPTION OF INVENTION

The invention describes a new composition that is effective at reducing the Cu and Pb corrosion of engine oils containing high levels of organo-molybdenum compounds while also maintaining effective protection of fluoroelastomer seals used in combustion engines. The invention also describes new engine oil compositions containing high levels of molybdenum that are resistant to Cu and Pb corrosion and compatible with fluoroelastomer seals. The invention also describes a method of reducing Cu and Pb corrosion in engine oils formulated with high levels of organomolybdenum compounds while also maintaining fluoroelastomer seal compatibility.

The composition comprises (A) an organo-molybdenum compound, and (B) an alkylated diphenylamine derivative of triazole.

The new engine oil compositions comprise: (A) an organo-molybdenum compound, (B) an alkylated diphenylamine derivative of triazole, and (C) one or more base oils, and, optionally, (D) one or more additives selected from the group including antioxidants, dispersants, detergents, anti-wear additives, extreme pressure additives, friction modifiers, rust inhibitors, corrosion inhibitors, seal swell agents, anti-foaming agents, pour point depressants and viscosity index modifiers.

The method of reducing Cu and Pb corrosion while maintaining fluoroelastomer seal compatibility involves adding (A) and (B), either as a blend, as individual components or as a blend or individual components in combination with the optional additives described in (D), to a lubricating engine oil that is determined to be corrosive to Cu and/or Pb as determined by the High Temperature Corrosion Bench Test ASTM D 6594 when B is not present. An oil corrosive to Cu is one that reports an end of test used oil Cu level increase above the 20 ppm maximum for the heavy duty diesel CJ-4 specification. An oil corrosive to Pb is one that reports an end of test used oil Pb level increase above the 120 ppm maximum for the heavy duty diesel CJ-4 specification.

DESCRIPTION OF PRIOR ART

U.S. Application 20100173808 and 20080200357 describe the use of derivatized triazoles, but molybdenum is not present or mentioned. U.S. Application 20040038835 describes derivatized triazoles but does not teach the importance of fluoroelastomer seal compatibility. U.S. Pat. No. 5,580,482 describes derivatized triazoles used in triglyceride ester oils but molybdenum is not mentioned or present.

The importance of fluoroelastomers (also known as Viton® a registered trademark of Dupont) in automotive applications is disclosed in U.S. application 2012/0258896. U.S. Pat. No. 6,723,685 teaches that certain nitrogen-containing lubricant additives can contribute to fluoroelastomer seal degradation over time.

SUMMARY OF THE INVENTION

It is known that the use of organo-molybdenum compounds in lubricants provides a number of beneficial properties including oxidation protection, deposit control, wear protection and friction reduction for improved fuel economy performance. There are generally two classes of molybdenum compounds that are utilized to achieve these benefits. They are the sulfur-containing organo-molybdenum compounds, of which the molybdenum dithiocarbamates and tri-nuclear organo-molybdenum compounds are the best known, and the sulfur-free organo-molybdenum compounds of which the organo-molybdate esters and molybdenum carboxylates are the best known. These products provide valuable benefits to lubricants but also have limitations. The main limitation is that they tend to be corrosive to Cu and Pb in engine oils, primarily heavy duty diesel engine oils. Corrosion for diesel engine oils is determined using the High Temperature Corrosion Bench Test ASTM D 6594. Oils will fail for Cu corrosion if the after test used oil has a Cu level increase that exceeds 20 ppm. Oils will fail for Pb corrosion if the end of test used oil has a Pb level increase that exceeds 120 ppm. This corrosion issue has limited the level of organo-molybdenum compounds that can be used in lubricants, especially heavy duty diesel engine oils. Based on the type of molybdenum compound selected, either Cu, Pb, or both, may be problematic for corrosion. Thus, very low levels of organo-molybdenum compounds, and sometimes none at all, are used in certain heavy duty diesel engine oil formulations in order to pass the ASTM D 6594. This tends to be a major limitation in formulating crankcase engine oils, especially heavy duty diesel engine oils, since molybdenum compounds can be quite valuable for improving the other properties stated above. Thus, a need exists for reducing the Cu and Pb corrosion of organo-molybdenum compounds when used in engine oil, and especially heavy duty diesel engine oil formulations. Specifically, a need exists to pass the High Temperature Corrosion Bench Test ASTM D 6594 for Cu and Pb corrosion in engine oil formulations containing high levels of organo-molybdenum compounds.

Technologies have been reported to reduce Pb corrosion in ASTM D 6594. For example, US patent application 2004/0038835 shows that certain alkylamine derivatives of 1,2,4-triazole metal deactivators are effective at reducing Pb corrosion when certain glycerol-based additives and sulfur compounds are present in the engine oil. However, this application does not discuss the effects of Cu corrosion or the impact these alkylamine derivatives of 1,2,4-triazole have on compatibility with fluoroelastomer seals.

In this patent application it is shown that alkylamine derivatives of 1,2,4-triazole, while sometimes effective at reducing Cu and/or Pb corrosion, are poor additives for engine oils because they lack compatibility with fluoroelastomer seals (see Example 2C compared to 2A, and Example 2F compared to 2B). Engine oil compatibility with typical fluoroelastomer seals is evaluated according to the procedure described in the ASTM D7216. FKM is one of the typical fluoroelastomer sealing materials used in automotive applications in contact with engine oil. Compatibility of the fluoroelastomer is evaluated by determining the changes in hardness and tensile properties when the elastomer specimens are immersed in the test lubricant for 336±0.5 hours at 150° C. Tensile properties and hardness of elastomers are evaluated according to the procedure described in ASTM D471 and ASTM D2240 respectively. ILSAC GF-5 specification limits the changes in the tensile properties and hardness to (−65, +10) and (−6, +6) respectively. However, any significant negative effect on seal compatibility is viewed as problematic in engine oil formulations. Thus a need exists to not only pass the specification limits, but also to show no harm or no significant change in ASTM D7216 when a new additive is present.

This invention provides compositions and methods of achieving these goals. Specifically, this invention provides compositions and methods of reducing Cu and Pb corrosion, as determined by ASTM D 6594, in engine oils formulated with high levels of molybdenum, while still maintaining compatibility, or neutrality, towards fluoroelastomer seal degradation.

Even small improvements in Cu and Pb corrosion protection in the presence of organo-molybdenum compounds would prove of significant value in advanced engine oil formulations. For example, even the ability to increase the level of molybdenum from 0-25 ppm to 75-200 ppm in a finished heavy duty diesel engine oil formulation would allow the use of molybdenum to better control oxidation, deposits and wear.

This invention allows the use of significantly higher levels of organo-molybdenum compounds (at least up to 320 ppm, and possibly up to 800 ppm) in engine oil formulations that are required to pass the High Temperature Corrosion Bench Test ASTM D 6594. In addition, corrosivity of engine oil formulations were also evaluated by modifying the temperature and test duration used in ASTM D 6594 where a higher temperature and shorter test duration compared to ASTM D 6594 were used. These include primarily heavy duty diesel engine oils. However, the invention should have utility in any engine oil formulation where Cu and Pb corrosion can be a problem. Other examples include passenger car engine oils, marine diesel oils, railroad diesel oils, natural gas engine oils, racing oils, hybrid engine oils, turbo-charged gasoline and diesel engine oils, engine oils used in engines equipped with direct injection technology, and two- and four-cycle internal combustion engines.

This invention will provide the ability to use higher levels of organomolybdenum in heavy duty diesel engine oils to solve a variety of possible performance problems including improved oxidation control, improved deposit control, better wear protection, friction reduction and improvements in fuel economy and overall lubricant robustness and durability.

This invention may represent a very cost effective way to provide a small increase in molybdenum content of heavy duty diesel engine oils. Most heavy duty diesel oils today do not contain molybdenum, or if they do at very low levels (less than 50 ppm). This invention could allow the use of 50 to 800 ppm, preferably 75-320 ppm of molybdenum in a very cost effective way. Higher levels of molybdenum are possible with this technology but at a higher cost.

Component A—Organo-Molybdenum Compounds

Component A may be a sulfur-containing organo-molybdenum compound or a sulfur-free organo-molybdenum compound.

The sulfur-containing organo-molybdenum compound may be mono-, di-, tri- or tetra-nuclear as described in U.S. Pat. No. 6,723,685. Dinuclear and trinuclear sulfur-containing organo-molybdenum compounds are preferred. More preferably, the sulfur-containing organo-molybdenum compound is selected from the group consisting of molybdenum dithiocarbamates (MoDTC), molybdenum dithiophosphates (MoDTP), molybdenum dithiophosphinates, molybdenum xanthates, molybdenum thioxanthates, molybdenum sulfides and mixtures thereof.

The sulfur-containing organo-molybdenum compounds that may be used include tri-nuclear molybdenum-sulfur compounds as described in European Patent Specification EP 1 040 115 and U.S. Pat. No. 6,232,276, molybdenum dithiocarbamates as described in U.S. Pat. Nos. 4,098,705, 4,178,258, 5,627,146, and U.S. Patent Application 20120264666, sulfurized oxymolybdenum dithiocarbamates as described in U.S. Pat. Nos. 3,509,051 and 6,245,725, molybdenum oxysulfide dithiocarbamates as described in U.S. Pat. Nos. 3,356,702 and 5,631,213, highly sulfurized molybdenum dithiocarbamates as described in U.S. Pat. No. 7,312,348, highly sulfurized molybdenum oxysulfide dithiocarbamates as described in U.S. Pat. No. 7,524,799, imine molybdenum dithiocarbamate complexes as described in U.S. Pat. No. 7,229,951, molybdenum dialkyl dithiophosphates as described in Japanese Patents 62039696 and 10121086 and U.S. Pat. Nos. 3,840,463, 3,925,213 and 5,763,370, sulfurized oxymolybdenum dithiophosphates as described in Japanese Patent 2001040383, oxysulfurized molybdenum dithiophosphates as described in Japanese Patents 2001262172 and 2001262173, and molybdenum phosphorodithioates as described in U.S. Pat. No. 3,446,735.

In addition, the sulfur containing organo-molybdenum compounds may be part of a lubricating oil dispersant as described in U.S. Pat. Nos. 4,239,633, 4,259,194, 4,265,773 and 4,272,387, or part of a lubricating oil detergent as described in U.S. Pat. No. 4,832,857.

Examples of commercial sulfur-containing organo-molybdenum compounds that may be used include MOLYVAN 807, MOLYVAN 822 and MOLYVAN 2000, and MOLYVAN 3000, which are manufactured by Vanderbilt Chemicals, LLC, and SAKURA-LUBE 165 and SAKURA-LUBE 515, which are manufactured by Adeka Corporation, and Infineum C9455, which is manufactured by Infineum International Ltd.

The treat level of the sulfur-containing organo-molybdenum compound in the engine oil compositions may be any level that will result in Cu and/or Pb corrosion as determined by the High Temperature Corrosion Bench Test ASTM D 6594. Actual treat levels can vary from 25 to 1000 ppm molybdenum metal and will vary based on the amount of components B and C, the engine oil additives present in the formulation and the base oil type used in the finished lubricant. Preferred levels of sulfur-containing organo-molybdenum are 50 to 500 ppm molybdenum metal and the most preferred levels are 75 to 350 ppm molybdenum metal.

The sulfur-free organo-molybdeum compounds that may be used include organo-amine complexes with molybdenum as described in U.S. Pat. No. 4,692,256, glycol molybdate complexes as described in U.S. Pat. No. 3,285,942, molybdenum imide as described in U.S. Patent Application 20120077719, organo-amine and organo-polyol complexes with molybdenum as described in U.S. Pat. No. 5,143,633, sulfur-free organo-molybdenum compounds with high molybdenum content as described in U.S. Pat. Nos. 6,509,303, 6,645,921 and 6,914,037, molybdenum complexes prepared by reacting a fatty oil, diethanolamine and a molybdenum source as described in U.S. Pat. No. 4,889,647; an organomolybdenum complex prepared from fatty acids and 2-(2-aminoethyl) aminoethanol as described in U.S. Pat. No. 5,137,647, 2,4-heteroatom substituted-molybdena-3,3-dioxacycloalkanes as described in U.S. Pat. No. 5,412,130, and molybdenum carboxylates as described in U.S. Pat. Nos. 3,042,694, 3,578,690 and RE30642.

In addition, the sulfur-free organo-molybdenum compounds may be part of a lubricating oil dispersant as described in U.S. Pat. Nos. 4,176,073, 4,176,074, 4,239,633, 4,261,843, and 4,324,672, or part of a lubricating oil detergent as described in U.S. Pat. No. 4,832,857.

Examples of commercial sulfur-free organo-molybdenum compounds that may be used include MOLYVAN 855, which is manufactured by Vanderbilt Chemicals, LLC, SAKURA-LUBE 700 which is manufactured by Adeka Corporation, and 15% Molybdenum HEX-CEM, which is manufactured by OM Group Americas, Inc.

The treat level of the sulfur-free organo-molybdenum compound in the engine oil compositions may be any level that will result in Cu and/or Pb corrosion as determined by the High Temperature Corrosion Bench Test ASTM D 6594. Actual treat levels can vary from 25 to 1000 ppm molybdenum metal and will vary based on the amount of components A and C, the engine oil additives present in the formulation and the base oil type used in the finished lubricant. Preferred levels of sulfur-free organo-molybdenum are 50 to 500 ppm molybdenum metal and the most preferred levels are 75 to 350 ppm molybdenum metal.

Component B—Alkylated Diphenylamine Derivatives of Triazole

Key features of the alkylated diphenylamine derivatives of triazoles is that they are not derivatized tolutriazoles or derivatized benzotriazoles, and they are also not alkylamine derivatives of triazoles. This is an important distinction in their ability to function as effective corrosion inhibitors when in the presence of organo-molybdenum compounds and yet showing no harm to fluoroelastomer seals. It is believed that the alkylated diphenylamine derivatives of triazoles of this invention are made more effective for two reasons. First, due to the absence of a fused aromatic ring they become more effective corrosion inhibitors. Second, due to the absence of an alkylamine they are not detrimental, or considered neutral, to fluoroelastomer seals. The combination of these two attributes in one molecule is novel.

The alkylated diphenylamine derivatives of triazole are prepared from 1,2,4-triazole (triazole), a formaldehyde source and alkylated diphenylamine by means of the Mannich reaction. These reactions are described in U.S. Pat. No. 4,734,209 where the alkylated diphenylamine is replaced by various secondary amines, and in U.S. Pat. No. 6,184,262, where the triazole is replaced by benzotriazole or tolutriazole. Water is a by-product of the reaction. The reaction may be carried out in a volatile organic solvent, in diluent oil or in the absence of a diluent. When a volatile organic solvent is used, in general the solvent is removed by distillation after the reaction is complete. A slight stoichiometric excess of either the 1,2,4-triazole, the formaldehyde source, or the alkylated diphenylamine may be used without adversely affecting the utility of the final product isolated. The triazole derivatives are of general formula I (I)

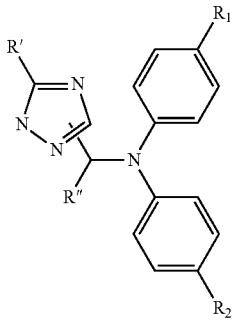

wherein R' and R" are independently selected from hydrogen or lower alkyl, R1 and R2 are independently selected from alkyl having up to 12 carbon atoms or phenylalkyl, or mixtures thereof. The triazole derivatives of formula I may also be represented by the following discrete chemical structures where each possible isomer are described:

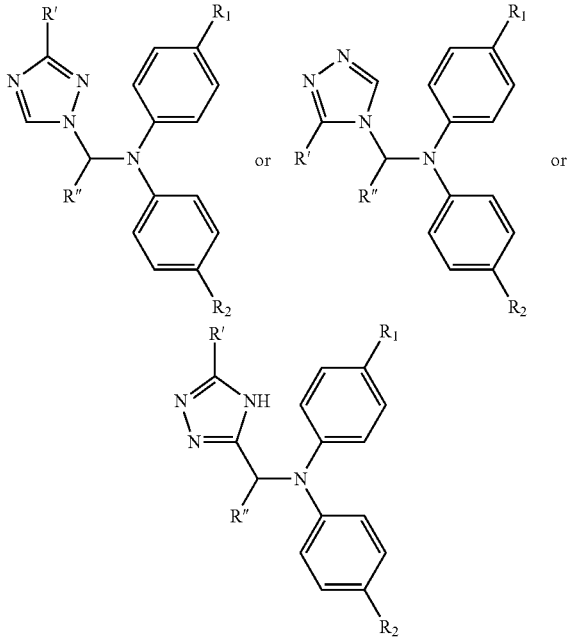

It is understood that in preparing these alkylated diphenylamine derivatives of triazole, many possible isomers of the derivatives are possible. Below are other ways of possibly naming these molecules where R' and R" are hydrogen, and R1 and R2 are alkyl:

1H-1,2,4-triazole-1-methanamine, N,N-bis(4-alkylphenyl)-N,N-bis(4-alkylphenyl)-((1,2,4-triazol-1-yl)methyl) amine N,N-bis(4-alkylphenyl)aminomethyl-1,2,4-triazole N,N-bis(4-alkylphenyl)-((1,2,4-triazole-1-yl)methyl)amine Bis(4-alkylphenyl)(1H-1,2,4-triazol-1-ylmethyl)amine N,N-bis(4-alkylphenyl)-1H[(1,2,4-triazol-1-yl)methyl] amine N,N-bis(4-alkylphenyl)-[(1,2,4-triazol-1-yl)methyl]amine N,N-bis(4-alkylphenyl)-1,2,4-triazole-1-ylmethanamine The alkylated diphenylamine portion of the triazole derivatives may be propylated, butylated, pentylated, hexylated, heptylated, octylated, nonylated, decylated, undecylated, dodecylated, tridecylated, tetradecylated, pentadecylated and hexadecylated). The alkyl groups may be linear, branched or cyclic in nature. Preferably, the alkylated diphenylamine portion of the triazole derivative is butylated, octylated or nonylated. Examples include:

1-[(4-butylphenyl)(phenyl)aminomethyl]triazole

1-[(4-octylphenyl)(phenyl)aminomethyl]triazole

1-[di-(4-butylphenyl)aminomethyl]triazole

1-[di-(4-octylphenyl)aminomethyl]triazole

1-[(4-nonylphenyl)(phenyl)aminomethyl]triazole

1-[di-(4-nonylphenyl)aminomethyl]triazole

1-[(4-butylphenyl)(4-octylphenyl)aminomethyl]triazole

Also contemplated is a mixture of molecules described as 1-[di-(4-mixed butyl/octylphenyl)aminomethyl]triazole, which comprises a mixture of 1-[(4-butylphenyl) (phenyl) aminomethyl]triazole, 1-[(4-octylphenyl) (phenyl) aminomethyl]triazole, 1-[di-(4-butylphenyl)aminomethyl]triazole, 1-[di-(4-octylphenyl)aminomethyl]triazole, and 1-[(4-butylphenyl) (4-octylphenyl) aminomethyl]triazole.

Particularly preferred are alkylated diphenylamine derivatives of triazole, being octylated or higher alkylated diphenylamine derivatives of triazole (e.g. nonylated, decylated, undecylated, dodecylated, tridecylated, tetradecylated, pentadecylated, hexadecylated). The alkyl groups may be linear, branched or cyclic in nature. Preferably, the novel molecule is 1-[di-(4-octylphenyl)aminomethyl]triazole or 1-[di-(4-nonylphenyl)aminomethyl]triazole. However, it is expected that a molecule which has at least one phenyl group being octylated or higher alkyl, where the other phenyl group may be alkylated with C7 or lower, such as C4, would also be effective. For example, also contemplated is a mixture of molecules described as 1-[di-(4-mixed butyl/octylphenyl) aminomethyl]triazole, which comprises a mixture of 1-[(4-butylphenyl) (phenyl) aminomethyl]triazole, 1-[(4-octylphenyl) (phenyl) aminomethyl]triazole, 1-[di-(4-butylphenyl)aminomethyl]triazole, 1-[di-(4-octylphenyl) aminomethyl]triazole, and 1-[(4-butylphenyl) (4-octylphenyl) aminomethyl]triazole. In cases where the molecule or mixture of molecules is present in a lubricating composition, it may be that the effective amount of the mixture of molecules would be based on the proportion of the octylated or higher alkyl which is present.

The treat level of the alkylated diphenylamine derivative of triazole in the engine oil compositions may be any level necessary to reduce Cu and Pb corrosion, or any level necessary to pass the High Temperature Corrosion Bench Test ASTM D 6594 for Cu and Pb when component A by itself fails. A practical range is from 0.01 wt % to 5.0 wt %. Preferred ranges are 0.05 wt % to 3.0 wt %. A most preferred range is 0.1 wt % to 2 wt %. It is understood that because the alkylated diphenylamine derivatives of triazole of this invention are not detrimental to elastomer seals, they can be used at very high levels without having a negative impact on the engine oil formulation.

Component C—Base Oils

Mineral and synthetic base oils may be used including any of the base oils that meet the API category for Group I, II, III, IV and V.

Component D—Additional Additives

Additional additives are selected from the group including antioxidants, dispersants, detergents, anti-wear additives, extreme-pressure additives, friction modifiers, rust inhibitors, corrosion inhibitors, seal swell agents, anti-foaming agents, pour point depressants and viscosity index modifiers. One or more of each type of additive may be employed. It is preferred that the anti-wear additives contain phosphorus.

For a heavy duty diesel engine oil, the additional additives would include one or more dispersants, one or more calcium or magnesium overbased detergents, one or more antioxidants, zinc dialkyldithiophosphate as the anti-wear additive, one or more organic friction modifiers, a pour point depressant and one or more viscosity index modifiers. Optional additional additives used in heavy duty diesel engine oils include: (1) supplemental sulfur-based, phosphorus-based or sulfur- and phosphorus-based anti-wear additives. These supplemental anti-wear additives may contain ash producing metals (Zinc, Calcium, Magnesium, Tungsten, and Titanium for example) or they may be ashless, (2) supplemental antioxidants including sulfurized olefins, and sulfurized fats and oils. The following list shows representative additives that may be used in heavy duty diesel engine oil formulations in combination with the additives of this invention:

Octylated diphenylamine
Mixed butylated/octylated diphenylamine
Nonylated diphenylamine
Octylated phenyl-α-naphthylamine
Nonylated phenyl-α-naphthylamine
Dodecylated phenyl-α-naphthylamine
Methylenebis(di-n-butyldithiocarbamate)
3,5-di-tert-butyl-4-hydroxyhydrocinnamic acid, $C_{10}$-$C_{14}$ alkyl esters
3,5-di-tert-butyl-4-hydroxyhydrocinnamic acid, $C_7$-$C_9$ alkyl esters
3,5-di-tert-butyl-4-hydroxyhydrocinnamic acid, iso-octyl ester
3,5-di-tert-butyl-4-hydroxyhydrocinnamic acid, butyl ester
3,5-di-tert-butyl-hydroxyhydrocinnamic acid, methyl ester,
4,4'-methylenebis(2,6-di-tert-butylphenol)
Glycerol mono-oleate
Oleamide
Octylated diphenylamine derivative of tolutriazole
N,N'bis(2-ethylhexyl)-ar-methyl-1H-benzotriazole-1-methanamine
Dialkylammonium Tungstate
Zinc diamyldithiocarbamate
Borate ester derived from the reaction product of a fatty oil and diethanolamine butanedioic acid (4,5-dihydro-5 thioxo-1,3,4-thiadiazol-2-yl) thio-bis(2-ethylhexyl)ester
3-[[bis(1-methylethoxy)phosphinothioyl]thio]propionic acid, ethyl ester
Dialkyldithiophosphate succinates
Dialkylphosphoric acid mono alkyl primary amine salts
2,5-dimercapto-1,3,4-thiadiazole derivatives The method of reducing Cu and Pb corrosion in engine oils while also maintaining fluoroelastomer seal compatibility involves adding component B to an engine oil that fails the High Temperature Corrosion Bench Test ASTM D 6594 for Cu and/or Pb corrosion when component A, is present.

It is also contemplated that the additive combinations of this invention are effective top treats to existing heavy duty diesel engine oil formulations. For example, it may be desired to improve the antioxidant, antiwear, frictional properties or deposit control properties of an existing commercial heavy duty diesel engine oil. This would represent a performance improvement beyond what is required for commercial licensing purposes. In such a case a blend of Components A and B would permit the use of high levels of molybdenum for achieving higher performance attributes while still controlling Cu and Pb corrosion and also maintaining fluoroelastomer seal compatibility. Thus a method of enhancing the performance of a heavy duty diesel engine oil would involve adding to the heavy duty diesel engine oil a blend of Component A and B. Additionally, the invention contemplates an engine oil, particularly a heavy duty diesel engine oil, having components A and B present, each component being present either as part of the engine oil formulation, or as an additive.

The lubricating composition of the invention comprises a major amount of base oil (e.g. at least 80%, preferably at least 85% by weight) and an additive composition comprising:

(A) an organo-molybdenum compound, and (B) an alkylated diphenylamine derivative of 1,2,4-triazole.

(A) may be present in the lubricating composition in an amount which provides about 50-800 ppm molybdenum, preferably about 75-320 ppm molybdenum. (B) is present in the lubricating composition in an amount between 0.01 wt. % and 5.0 wt. %, preferably between 0.05 and 3.0 wt. %, and most preferably between 0.1 wt % and 2.0 wt. %.

It is noted that the amount of alkylated diphenylamine derivative of triazole may be correlated to the total amount of molybdenum, such that at lower molybdenum amounts, less alkylated diphenylamine derivative of triazole is needed. For example, when (A) provides between about 50-200 ppm molybdenum, preferably about 120 ppm Mo, (B) is present at between about 0.05-0.50 wt %. When (A) provides between about 250-500 ppm molybdenum, preferably about 320 ppm Mo, (B) is present at between about 0.1-3.0 wt %, preferably about 0.2-2.0 wt %.

The invention also contemplates an additive concentrate for adding to a lubricating composition, the additive concentrate comprising components (A) and (B) as above, wherein the ratio of (A):(B) is from about 50:1 to 1:2 based on the amount of molybdenum metal to the amount of derivatized triazole additive by weight, preferably about 33:1 to 1:1.

Attempts were made to try and reduce copper and lead corrosion in the High Temperature Corrosion Bench Test, ASTM D 6594, by using more traditional corrosion inhibitors such as derivatized tolutriazoles (CUVAN® 303) and 2,5 dimercapto-1,3,4-thiadiazole derivative (CUVAN® 826). The former produced very high lead corrosion and the latter produced very high copper corrosion. Switching from a derivatized tolutiazole to a derivatized triazole provided acceptable lead and copper corrosion reduction.

EXAMPLES

HTCBT Corrosion (Examples 1A through 1J)

Corrosion potential of these lubricants towards copper and lead metals was evaluated using the high temperature corrosion bench test (HTCBT) according to the ASTM D 6594 test method. Details of the test method can be found in the annual book of ASTM standards. For the test specimen 100±2 grams of lubricant was used. Four metal specimens each of copper, lead, tin and phosphor bronze were immersed in a test lubricant. The test lubricant was kept at 135° C. and dry air was bubbled through at 5±0.5 L/h for 1 week. The API CJ-4 specifications for heavy duty diesel engine oil limits the metal concentration of copper and lead in the oxidized oil as per ASTM D 6594 test methods to 20 ppm maximum and 120 ppm maximum respectively. After testing, the lubricants were analyzed for the Cu and Pb metal in the oil using the Inductive Coupled Plasma (ICP) analytical technique.

In Tables 1, 2 and 3, "base blend" is an SAE 15W-40 SAE viscosity grade fully formulated heavy duty diesel engine oil consisting of base oils, dispersants, detergents, VI Improvers, antioxidants, antiwear agents, pour point depressants and any other additives. Base blend is then further formulated as described in the examples 1A to 1J. The 100% active alkylamine derivative of triazole used was IRGAMET® 30, 1-(N,N-bis(2-ethylhexyl)aminomethyl)-1,2,4-triazole available from BASF Corporation. The molybdenum dithiocarbamate used was MOLYVAN® 3000, a 10 wt. % molybdenum thiocarbamate available from Vanderbilt Chemicals, LLC. The molybdenum ester/amide used was MOLYVAN® 855, an 8 wt. % sulfur-free organo-molybdneum product available from Vanderbilt Chemicals, LLC.

The results in Table 1 clearly show that all three triazole derivatives are effective at reducing copper and lead corrosion in the HTCBT test when molybdenum is present in the heavy duty diesel engine oil formulations. The results also show that the mixed butylated/octylated diphenylamine derivative of triazole prepared in Example P-2 is about as effective as the alkylamine derivative of triazole at reducing corrosion when molybdenum is present.

TABLE 1

| | 1A | 1B | 1C | 1D |
|---|---|---|---|---|
| base blend (wt %) | 99.64 | 99.44 | 99.24 | 99.24 |
| molybdenum dithiocarbamate (wt %) | 0.16 | 0.16 | 0.16 | 0.16 |
| molybdenum ester/amide (wt %) | 0.2 | 0.2 | 0.2 | 0.2 |
| 100% active alkylamine derivative of triazole (wt %) | | 0.2 | | |
| 50% active dioctylated diphenylamine derivative of triazole (wt %) Example P-1 | | | 0.4 | |
| 50% active mixed butylated/octylated diphenylamine derivative of triazole (wt %) Example P-2 | | | | 0.4 |
| Total (wt %) | 100 | 100 | 100 | 100 |
| Mo (ppm) | 320 | 320 | 320 | 320 |
| ASTM D6594 | | | | |
| Cu (ppm) Run 1 | 225 | 7 | 51 | 8 |
| Cu (ppm) Run 2 | 265 | 6 | 48 | 7 |
| Cu (ppm) Run 3 | 272 | 384 | 600 | 6 |
| Pb (ppm) Run 1 | 101 | 47 | 67 | 40 |
| Pb (ppm) Run 2 | 116 | 43 | 99 | 50 |
| Pb (ppm) Run 3 | 82 | 102 | 14 | 42 |

The results in Table 2 clearly show that when one type of organo-molybdenum is used, in this case the molybdenum ester/amide, the use of alkylated diphenylamine derivatives of triazole (samples prepared in examples P-1 and P-2) are effective at reducing either copper or lead corrosion, or both, as measured in the HTCBT.

TABLE 2

| | 1E | 1F | 1G |
|---|---|---|---|
| base blend (wt %) | 99.8125 | 99.2 | 99.2 |
| molybdenum ester/amide (wt %) | 0.1875 | 0.4 | 0.4 |
| 50% active dioctylated diphenylamine derivative of triazole (wt %) Example P-1 | | 0.4 | |
| 50% active mixed butylated/octylated diphenylamine derivative of triazole (wt %) Example P-2 | | | 0.4 |
| Total (wt %) | 100 | 100 | 100 |
| Mo (ppm) | 150 | 320 | 320 |
| ASTM D6594 | | | |
| Cu Run 1 | 46 | 29 | 7 |
| Cu Run 2 | 405 | 7 | 8 |
| Cu Run 3 | 172 | 7 | 7 |
| Pb Run 1 | 144 | 48 | 117 |
| Pb Run 2 | 11 | 96 | 131 |
| Pb Run 3 | 140 | 122 | 112 |

The results in Table 3 clearly show that when one type of organo-molybdenum is used, in this case the molybdenum dithiocarbamate, the use of alkylated diphenylamine derivatives of triazole (samples prepared in examples P-1 and P-2) are effective at reducing either copper or lead corrosion, or both, as measured in the HTCBT.

TABLE 3

| | 1H | 1I | 1J |
|---|---|---|---|
| Base blend (wt %) | 99.85 | 99.28 | 99.28 |
| Molybdenum dithiocarbamate (wt %) | 0.15 | 0.32 | 0.32 |
| 50% active dioctylated diphenylamine derivative of triazole (wt %) Example P-1 | | 0.4 | |
| 50% active mixed butylated/octylated diphenylamine derivative of triazole (wt %) | | | 0.4 |

TABLE 3-continued

| | 1H | 1I | 1J |
|---|---|---|---|
| Example P-2 | | | |
| TOTAL | 100 | 100 | 100 |
| Mo (ppm) | 150 | 320 | 320 |
| ASTM D6594 | | | |
| Cu Run 1 | 10 | 258 | 27 |
| Cu Run 2 | 402 | 13 | 28 |
| Cu Run 3 | 72 | 13 | 62 |
| Pb Run 1 | 46 | 5 | 22 |
| Pb Run 2 | 6 | 28 | 38 |
| Pb Run 3 | 44 | 26 | 14 |

Fluoroelastomer Seal Compatibility (Examples 2A through 2H)

Engine oil compatibility with typical seal elastomers were evaluated according to the procedure described in the ASTM D7216. The elastomer used for the evaluation was fluoroelastomer, commonly known as FKM. FKM is one of the typical sealing materials used in automotive applications in contact with engine oil. Compatibility of elastomer is evaluated by determining the changes in hardness and tensile properties when the elastomer specimens are immersed in the test lubricant for 336±0.5 hours at 150° C. Tensile properties and hardness of elastomers were evaluated according to the procedure described in the ASTM D471 and ASTM D2240 respectively. ILSAC GF-5 specification limits the changes in the tensile properties and hardness to (−65, +10) and (−6, +6) respectively. The results are reported in Table 4.

TABLE 4

| | 2A | 2B | 2C | 2D | 2E | 2F | 2G | 2H |
|---|---|---|---|---|---|---|---|---|
| Base blend (wt %) | 100 | 99.64 | 99.8 | 99.6 | 99.6 | 99.44 | 99.24 | 99.24 |
| Molybdenum ester/amide (wt %) | | 0.2 | | | | 0.2 | 0.2 | 0.2 |
| Molybdenum dithiocarbamate (wt %) | | 0.16 | | | | 0.16 | 0.16 | 0.16 |
| 100% active alkylamine derivative of triazole (wt %) | | | 0.2 | | | 0.2 | | |
| 50% active dioctylated diphenylamine derivative of triazole (wt %) Example P-1 | | | | 0.4 | | | 0.4 | |
| 50% active mixed butylated/octylated diphenylamine derivative of triazole (wt %) Example P-2 | | | | | 0.4 | | | 0.4 |
| TOTAL | 100 | 100 | 100 | 100 | 100 | 100 | 100 | 100 |
| Change in Tensile Strength (%) | 40.09 | 36.61 | 56.83 | 40.51 | 38.69 | 55.75 | 37.94 | 37.36 |
| Change in Hardness | 3.8 | 3.9 | 5.1 | 3.2 | 3.8 | 4.8 | 3.0 | 3.8 |

Table 4 clearly shows that the base blend plus molybdenum (2B) and the base blend plus the alkylated diphenylamine derivatives of triazole (2D and 2E) are not detrimental, or are considered neutral, towards fluoroelastomer seal degradation. This is evidenced by virtually no change in tensile strength or hardness when moving from 2A to either 2B, 2D or 2E. Note, the formulations of this invention 2G and 2H are also neutral to fluoroelastomer seal degradation. However, formulations containing alkylamine derivatives of triazole (2C and 2F) show a substantial increase in tensile strength and hardness indicating that the alkylamine derivatives of triazole are detrimental to fluoroelastomer seals.

Thus the novel formulations comprising (a) an organomolybdenum compound, and (b) an alkylated diphenylamine derivative of triazole, can provide very effective protection against Cu and/or Pb corrosion as determine by ASTM D 6594, as well as being completely neutral towards the degradation of fluoroelastomer seals. It has been shown above, while the alkylamine derivatives of triazole are also effective at reducing Cu and Pb corrosion as determined by ASTM D 6594, they are severely detrimental towards flouroelastomer seal degradation, and thus do not provide a practical solution to the Cu and Pb corrosion problem.

HTCBT Corrosion (Examples 3 through 7)

In Table 5, "base blend" is SAE 0W-20 viscosity grade fully formulated engine oil consisting of base oils, dispersants, detergents, VI Improvers, antioxidants, antiwear agents, and pour point depressants. Base blend is then further formulated as described in the examples shown in table 5.

Corrosivity of these formulations towards copper and lead metals was evaluated using high temperature corrosion bench test (HTCBT) according to the ASTM D 6594 test methods and the modified HTCBT method. In the modified HTCBT method, the test lubricant was kept at 165° C. and dry air was bubbled through the lubricant at 5±0.5 L/h for 48 hours. After the test, the lubricants were analyzed for the Cu and Pb metal in the oil using Inductive Coupled Plasma (ICP) analytical technique.

Example 3 shows the effect adding molybdenum has to increase Cu and Pb corrosion in heavy duty diesel engine oil according to ASTM D 6594 and the modified HTCBT test. Examples 4 and 5 show the beneficial properties of alkylamine derivatives of triazole as previously discussed. Although the alkylamine derivatives of triazole are effective at reducing corrosion, Examples 2C and 2F above clearly show that they are very detrimental to seal compatibility. Example 6 is a comparative example using N,N-Bis(2-ethylhexyl)-ar-methyl-1H-benzotriazole-1-methanamine, an alkylamine derivative of tolutriazole corrosion inhibitor available from Vanderbilt Chemicals, LLC as CUVAN® 303. Example 7 is a comparative example using 2,5-dimercapto-1,3,4-thiadiazole derivative, a sulfur-based corrosion inhibitor available from Vanderbilt Chemicals LLC as CUVAN® 826. Examples 6 and 7 clearly show that the comparative corrosion inhibitors are not as effective as the triazole corrosion inhibitor in example 4.

TABLE 5

| | Examples | | | | |
|---|---|---|---|---|---|
| | 3 | 4 | 5 | 6 | 7 |
| 1 Base Blend* | 99.637 | 99.437 | 99.437 | 99.437 | 99.437 |
| 2 Molybdenum Ester/Amide (wt %) | 0.2 | 0.2 | 0.2 | 0.2 | 0.2 |
| 3 Molybdenum Dithiocarbamate (wt %) | 0.163 | 0.163 | 0.163 | 0.163 | 0.163 |
| 4 100% active alkylamine derivative of triazole (wt %) | | 0.2 | | | |
| 5 100% active alkylamine derivative of triazole (wt %) alternative source | | | 0.2 | | |
| 6 N,N Bis(2-ethylhexyl)-ar-methyl-1H-benzotriazole-1-methanamine | | | | 0.2 | |
| 7 2,5 dimercapto-1,3,4-thiadiazole derivative | | | | | 0.2 |
| 8 Total | 100 | 100 | 100 | 100 | 100 |
| ASTM D6594 | | | | | |
| Cu (20 ppm max.) Run 1 | 97 | 4 | 4 | 4 | 390 |
| Cu (20 ppm max.) Run 2 | 101 | 4 | 12 | 2 | 366 |
| Pb (120 ppm max.) Run 1 | 41 | 2 | <1 | 13 | 114 |
| Pb (120 ppm max.) Run 2 | 52 | 1 | 224 | 190 | 102 |
| Modified HTCBT Method | | | | | |
| Cu (20 ppm max.) Run 1 | 164 | 6 | 4 | 26 | 50 |
| Cu (20 ppm max.) Run 2 | 164 | 4 | 3 | 25 | 214 |
| 9 Pb (120 ppm max.) Run 1 | 28 | 8 | 2 | 14 | 6 |
| 10 Pb (120 ppm max.) Run 2 | 20 | 22 | 2 | 165 | 17 |

Example P-1: Preparation of 1-(N,N-bis(4-(1,1,3,3-tetramethylbutyl)phenyl)aminomethyl)-1,2,4-triazole in 50% Process Oil In a 500 mL three-necked round bottom flask equipped with a temperature probe, overhead stirrer and Dean Stark set up were charged VANLUBE® 81 (dioctyl diphenylamine) (62.5 g, 0.158 mole), 1,2,4-triazole (11.0 g, 0.158 mole), paraformaldehyde (5.5 g, 0.158 mole), water (3 g, 0.166 mole) and process oil (37.7 g). The mixture was heated under nitrogen to 100-105° C. with rapid mixing. Mixing was continued at 100° C. for one hour. After one hour, water aspirator vacuum was applied and the reaction temperature was raised to 120° C. The reaction mixture was held at this temperature for an hour. The expected amount of water was recovered, suggesting a complete reaction occurred. The reaction mixture was allowed to cool to 90° C., and transferred to a container. A light amber liquid (102.93 g) was isolated.

Example P-2: Preparation of Mixed Butylated/Octylated Diphenylamine Derivative of 1,2,4-triazole in 50% Process Oil In a 500 mL three-necked round bottom flask equipped with a temperature probe, overhead stirrer and Dean Stark set up were charged VANLUBE® 961 (mixed butylated/octylated diphenylamine) (60 g, 0.201 mole), 1,2,4-triazole (13.9 g, 0.200 mole), paraformaldehyde (6.8 g, 0.207 mole), water (3.8 g, 0.208 mole) and process oil (77 g). The mixture was heated under nitrogen to 100-105° C. with rapid mixing. Mixing was continued at 100° C. for one hour. After one hour, water aspirator vacuum was applied and the reaction temperature was raised to 120° C. The reaction mixture was held at this temperature for an hour. The expected amount of water was recovered, suggesting a complete reaction occurred. The reaction mixture was allowed to cool to 90° C., and transferred to a container. A dark amber liquid (138.86 g) was isolated.

What is claimed is:

1. A lubricating composition comprising a major amount of a lubricating base oil, and (A) an organo-molybdenum compound providing a total molybdenum content of about 50 ppm to 800 ppm in the lubricating composition and (B) an alkylated diphenylamine derivative of triazole present in the amount from about 0.01-5.0% by weight of the lubricant composition, wherein (B) excludes derivatized tolutriazoles and derivatized benzotriazoles.

2. The lubricating composition according to claim 1, wherein the total molybdenum content is about 75 ppm to about 350 ppm.

3. The lubricating composition according to claim 1, wherein the organo-molybdenum compound is selected from one or both of a molybdenum dithiocarbamate and a molybdenum ester/amide complex.

4. The lubricating composition according to claim 1, wherein the alkylated diphenylamine derivative of triazole is present in an amount from about 0.05-3.0% by weight of the lubricating composition.

5. The lubricating composition according to claim 1, wherein the ratio of (A):(B) based on molybdenum content (in wt %) to triazole derivative content (in wt %) is from about 0.001:1 to 20:1.

6. The lubricating composition according to claim 1 wherein the alkylated diphenylamine derivative of triazole is selected from one or both of 1-[di-(4-alkylphenyl)aminomethyl]triazole and 1-[di-4-alkylphenyl)(phenyl)aminomethyl]triazole.

7. The lubricating composition according to claim 6 wherein the alkylated diphenylamine derivative of triazole is selected from one or more of 1-[di-(4-butylphenyl)aminomethyl]triazole,
1-[di-(4-octylphenyl)aminomethyl]triazole,
1-[di-(4-nonylphenyl)aminomethyl]triazole,
1-[(4-butylphenyl)(phenyl)aminomethyl]triazole,
1-[(4-octylphenyl)(phenyl)aminomethyl]triazole,
1-[(4-nonylphenyl)(phenyl)aminomethyl]triazole and
1-[(4-butylphenyl)(4-octylphenyl)aminomethyl]triazole.

8. A method of reducing high temperature copper and lead corrosion in a heavy duty diesel engine oil, comprising between about 50 ppm and about 800 ppm molybdenum, the method comprising the step of adding to the engine oil an alkylated diphenylamine derivative of triazole at between 0.05% and 3.0% by weight of the engine oil, wherein the alkylated diphenylamine derivative of triazole excludes derivatized tolutriazoles and derivatized benzotriazoles.

9. The lubricating composition of claim 1, wherein the lubricating oil is one that is determined to be corrosive to Cu and/or Pb according to the High Temperature Corrosion Bench Test ASTM D 6594 when component (B) is not present.

10. An additive composition for use with a lubricating oil composition, the additive composition comprising (A) an organo-molybdenum composition, and (B) an alkylated diphenylamine derivative of triazole, wherein (B) excludes derivatized tolutriazoles and derivatized benzotriazoles, and the ratio of (A):(B) based on the amount of molybdenum by weight and the amount of triazole derivative by weight is from about 0.001:1 to 20:1.

11. A composition according to claim 10 where the triazole derivative is selected from one or more of 1-[di-(4-alkylphenyl)aminomethyl]triazole or 1-[di-4-alkylphenyl)(phenyl)aminomethyl]triazole.

12. A composition according to claim 11 where the triazole derivative is chosen from the group consisting of one or more of 1-[di-(4-butylphenyl)aminomethyl]triazole,
1-[di-(4-octylphenyl)aminomethyl]triazole,
1-[di-(4-nonylphenyl)aminomethyl]triazole,
1-[(4-butylphenyl)(phenyl)aminomethyl]triazole,
1-[(4-octylphenyl)(phenyl)aminomethyl]triazole,
1-[(4-nonylphenyl)(phenyl)aminomethyl]triazole and
1-[(4-butylphenyl)(4-octylphenyl)aminomethyl]triazole.

13. A composition according to claim 10, wherein the organo-molybdenum compound is one or both of molybdenum dithiocarbamate and molybdenum ester/amide complex.

14. The method according to claim 8, wherein the reduction of copper and/or lead corrosion is according to the High Temperature Corrosion Bench Test ASTM D 6594.

15. The method according to claim 8, wherein the molybdenum is present in the form of one or both of a molybdenum dithiocarbamate and a molybdenum ester/amide complex.

16. The method according to claim 8, wherein the triazole derivative is chosen from the group consisting of one or more of 1-[di-(4-butylphenyl)aminomethyl]triazole,
1-[di-(4-octylphenyl)aminomethyl]triazole,
1-[di-(4-nonylphenyl)aminomethyl]triazole,
1-[(4-butylphenyl)(phenyl)aminomethyl]triazole,
1-[(4-octylphenyl)(phenyl)aminomethyl]triazole,
1-[(4-nonylphenyl)(phenyl)aminomethyl]triazole and
1-[(4-butylphenyl)(4-octylphenyl)aminomethyl]triazole.

* * * * *